US005660335A

United States Patent [19]

Köppl et al.

[11] Patent Number: 5,660,335

[45] Date of Patent: Aug. 26, 1997

[54] METHOD AND DEVICE FOR THE COMMINUTION OF SEMICONDUCTOR MATERIAL

[75] Inventors: Franz Köppl, Erlbach; Matthäus Schantz, Reut, both of Germany

[73] Assignee: Wacker-Chemitronic Gesellschaft für Elektronik Grundstoffe mbH, Burghausen, Germany

[21] Appl. No.: 240,988

[22] Filed: May 11, 1994

[30] Foreign Application Priority Data

May 18, 1993 [DE] Germany ..... 43 16 626.1

[51] Int. Cl.[6] ..... B02C 19/06

[52] U.S. Cl. ..... 241/1; 241/15; 241/39

[58] Field of Search ..... 241/1, 5, 15, 39, 241/40

[56] References Cited

U.S. PATENT DOCUMENTS

| | | | |
|---|---|---|---|
| 3,595,486 | 7/1971 | Stephanoff | 241/5 |
| 3,881,660 | 5/1975 | Ribas | 241/5 |
| 4,323,198 | 4/1982 | Turner et al. | 241/5 |
| 4,723,715 | 2/1988 | Mazurkiewicz | 241/1 |
| 4,871,117 | 10/1989 | Bauereggar et al. | 241/23 |
| 4,986,479 | 1/1991 | Swarden et al. | 241/15 |
| 5,123,599 | 6/1992 | Mardigian | 241/20 |
| 5,346,141 | 9/1994 | Kim et al. | 241/5 |

FOREIGN PATENT DOCUMENTS 3811091 10/1989 Germany .

*Primary Examiner*—John M. Husar
*Attorney, Agent, or Firm*—Collard & Roe, P.C.

[57] ABSTRACT

A method for the contamination-free comminution of semiconductor material includes an apparatus by which the method is carried out. The method includes creating at least one liquid jet by applying pressure to a liquid and forcing it through a nozzle, and directing the liquid jet against the semiconductor material, so that it impinges on its surface at high velocity. The apparatus includes a container for receiving comminuted semiconductor material, at least one nozzle through which a liquid jet is directed at high velocity against the semiconductor material to be comminuted, a conveyor device for removing the comminuted semiconductor material from the container, means for releasing and interrupting the liquid jet, and means for positioning the nozzle and/or advancing the semiconductor material.

9 Claims, 1 Drawing Sheet

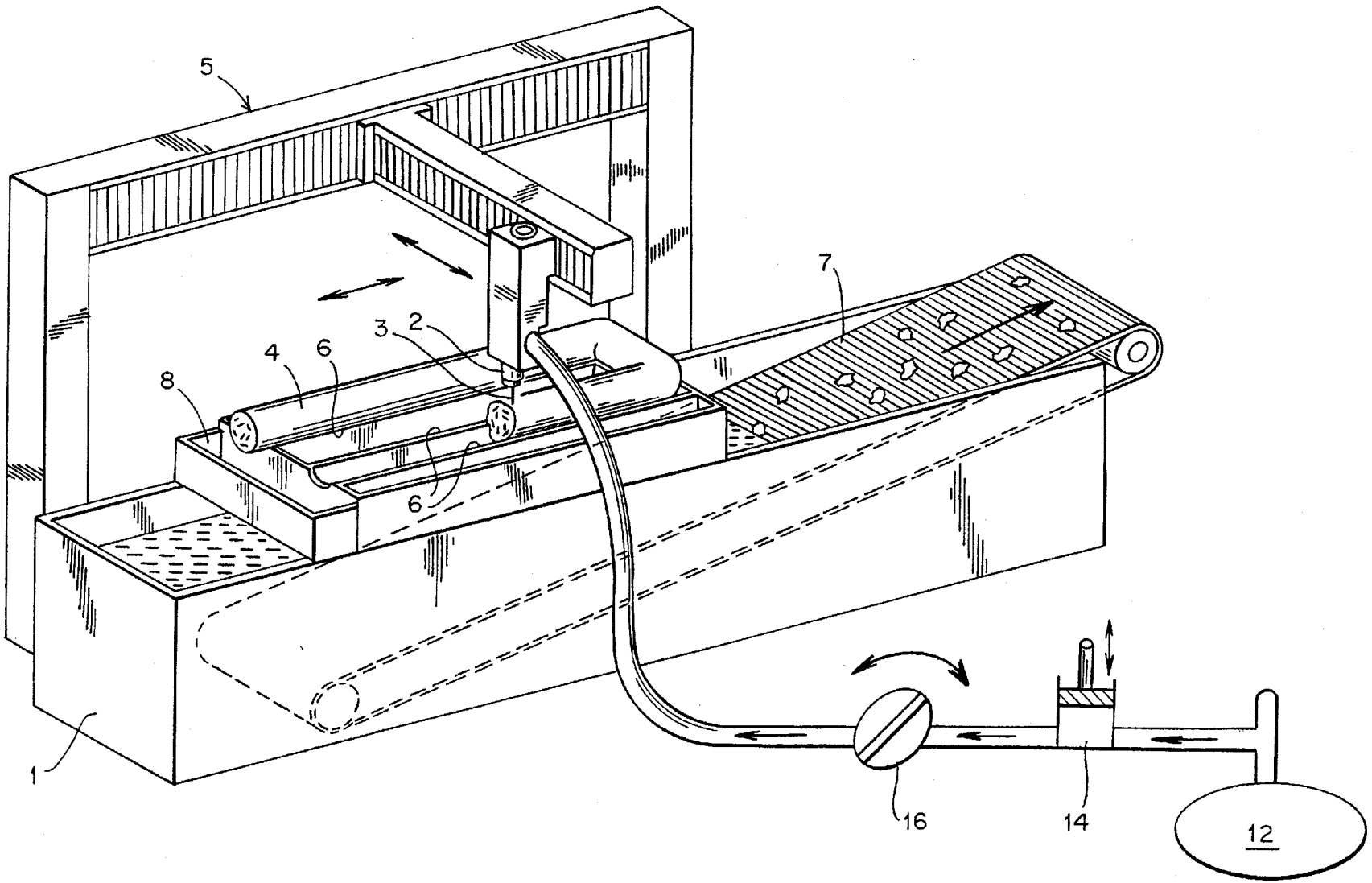
12
14
16
7
2
3
6
6
4
8
5
1

METHOD AND DEVICE FOR THE COMMINUTION OF SEMICONDUCTOR MATERIAL

BACKGROUND OF THE INVENTION

1. Field of the Invention

The present invention relates to a method for the contamination-free comminution of semiconductor material. Furthermore, the invention relates to an apparatus for carrying out the method.

2. The Prior Art

At the beginning of the production of many semiconductor products, it is necessary to provide semiconductor material in molten form. In most cases, the semiconductor material is melted for this purpose in crucibles or the like. Molded bodies are then cast, or crystals are then pulled from the melt by known methods. These are the basic material for products such as, for example, solar cells, memory chips or microprocessors. If the semiconductor material to be melted is in the form of solid large-volume bodies such as, for example, in rod form after a gas-phase deposition, it has to be comminuted for the melting process in the crucible. Only in this way is it possible to utilize the crucible volume efficiently and to achieve short and energy-saving melting times as a result of the large surface of the melting charge which has been introduced in small particles.

During the comminution, care has to be taken to ensure that the surfaces of the fragments are not contaminated with impurities. In particular, contamination with metal atoms is to be regarded as critical, since the latter can alter the electrical properties of the semiconductor material in a harmful way. If the semiconductor material to be comminuted is comminuted, as usually has been done in the past with mechanical tools such as, for example, steel crushers, the fragments have to be subjected to a complex and cost-intensive surface cleaning before melting.

According to DE-3,811,091 A1 and the corresponding U.S. Pat. No. 4,871,117 it is possible to decompact solid, large-volume silicon bodies in such a way that the mechanical comminution is possible even with tools whose working surfaces are composed of non-contaminating, or only slightly contaminating substances, such as silicon, or nitride ceramics or carbide ceramics. The decompacting is achieved by creating a temperature gradient in the silicon piece to be broken as a result of heat action from the outside and establishing a surface temperature of 400° C. to 1400° C., and rapidly reducing the latter by a value of at least 300° C. so that the temperature gradient at least partially reverses. To create the temperature gradient, the solid charge has to be placed in a furnace and heated. This method has, however, the disadvantage that, during the heating phase, the diffusion of impurities adsorbed at the surface of the semiconductor material is set in motion and/or accelerated. In this way, the impurities from the surface enter the crystal structure of the semiconductor material and consequently escape the cleaning measures which are able to remove only impurities near the surface. In addition, in the method mentioned, a contamination of the semiconductor material by impurities given off by the furnace material during the heating is virtually unavoidable.

SUMMARY OF THE INVENTION

It is an object of the present invention to provide a method by which semiconductor material can be comminuted in a contamination-free manner and without resorting to high temperatures and mechanical crushing tools.

It is a further object of the present invention to provide an apparatus for carrying out the method of the invention.

The above objects are achieved according to the invention by a method for the contamination-free comminution of semiconductor material, which method comprises creating at least one liquid jet by applying pressure to a liquid and forcing it through a nozzle, and directing the liquid jet against the semiconductor material so that it impinges on its surface at high velocity.

Furthermore, the above objects are achieved by an apparatus for the contamination-free comminution of semiconductor material. A container receives comminuted semiconductor material. There is provided at least one nozzle through which a liquid jet is directed at high velocity against the semiconductor material to be comminuted. A conveyor device removes comminuted semiconductor material from the container. There are provided means for releasing and interrupting the liquid jet, means for positioning the nozzle, and means for advancing the semiconductor material relative to said nozzle.

The method is preferably utilized to comminute brittle and hard semiconductor material such as silicon, germanium or gallium arsenide. In this regard, it is unimportant whether fragments are to be further comminuted or whether molded bodies, such as blocks or semiconductor rods, are to be comminuted. Since a liquid jet is the means which comminutes the semiconductor material, the risk of contaminating the semiconductor material with impurities during the comminution process can be considerably reduced by the choice of suitable and particularly pure liquids. In a preferred embodiment, pure water is used. It is also possible to use aqueous solutions, for example, those containing additives which remove impurities from the surface of the semiconductor material or which have surface-etching action. It is also further possible to use an organic solvent or organic solvent mixture, preferably a solvent or solvent mixture whose boiling point is low so that the drying of the comminuted semiconductor material is possible with comparatively low energy expenditure. The energy necessary for the comminution of the semiconductor material is produced by applying pressure to the liquid and forcing it through a nozzle, in which process a liquid jet leaves the nozzle at high velocity.

The liquid jet is directed against the semiconductor material so that it impinges on the surface of the semiconductor material at an angle of 30°–90°, preferably at an angle of 60°–90°, and most preferably perpendicularly.

The cross section at the nozzle tip and, consequently, the cross section of the liquid jet leaving the nozzle is desirably round, rectangular, square or polygonal, but it may also have a different shape. The cross-sectional area of the liquid jet leaving the nozzle is preferably 0.005 to 20 $mm^2$, and most preferably 0.05 to 3 $mm^2$, at the nozzle tip. It has been found that the nozzle can be directed at the semiconductor material so that the nozzle tip even touches the surface of the semiconductor material, provided steps are taken to ensure that the nozzle tip is made of an abrasion-resistant material which does not contaminate the semiconductor material, for example, sapphire. In order to eliminate contamination by the material of the nozzle and in case the semiconductor material is subjected to feed movements during the method, it is more beneficial, however, for the nozzle tip to be spaced apart from the surface of the semiconductor material. The preferred spacing of the nozzle tip directed at the semiconductor material from the surface of the semiconductor material is 0 to 150 mm, preferably 10 to 20 mm.

The pressure which has to be applied to the liquid, so that a liquid jet having sufficient kinetic energy for the comminution of the semiconductor material can be created, should be 500 to 5000 bar, preferably 1000 to 4000 bar. In principle, the procedure may be such that a constant liquid flow is created. As a rule, however, it is sufficient to interrupt the liquid jet as soon as the desired material breakage has taken place or to interrupt the liquid jet periodically in order to thereby divide it into a sequence of liquid-jet pulses. Finally, it is also possible to direct a periodically interrupted liquid jet against the semiconductor material not continuously, but with temporary interruptions. The time during which the liquid jet is maintained before it is interrupted (pulse duration) depends primarily on the thickness and compactness of the semiconductor material for a given device configuration. As a rule, pulse durations of 0.5 to 5 seconds are sufficient in order to effect, for example, the breakage of a silicon rod having a diameter of 120 mm into two or more pieces.

Fairly large semiconductor bodies can be comminuted by directing a liquid jet continuously or at intervals or a periodically interrupted liquid jet (only the term liquid jet is used for these variants hereinafter) against various points on the semiconductor material. In this process, the nozzle may remain fixed, for example, in a preselected position while the semiconductor material is advanced. A further development of the method envisages automating this step. Of course, it is also possible to align the nozzle continuously or at intervals with a new target, for example, with another point on the surface of the semiconductor body to be comminuted or with a fragment which was previously comminuted.

To increase the output of the method, provision may also be made for a plurality of liquid jets, preferably 2 to 5, to impinge on various points on the semiconductor material simultaneously or in a staggered manner. In this embodiment, it is preferable to proceed in such a way that the spacing of two liquid jets when impinging on the semiconductor material is at least 20 mm and not more than 120 mm. In this way, fragments can predominantly be produced which have a maximum length of 60 to 120 mm so that they are particularly suitable for filling melting crucibles. However, the possibility is also not excluded of choosing narrower or wider spacings of the liquid jets (if a plurality of liquid jets is used simultaneously) or narrower or wider spacings between two targets on the surface of the semiconductor material (if only one liquid jet is used) so that fragments having shorter or longer maximum lengths can predominantly be obtained.

Rod-shaped semiconductor material having diameters of 60 to 250 mm is preferably comminuted in such a way that at least one liquid jet is directed against the end face of the rod or at least one liquid jet is directed radially against the circumferential surface of the rod. Particularly preferably, one liquid jet is directed against the end face and one against the circumferential surface of the rod simultaneously or in succession. In another embodiment, it is preferable to alter the position of the semiconductor rod continuously or at intervals. To move the semiconductor rod to a new machining position, it is moved axially a preselected distance. In a further embodiment, means are also provided for rotating the semiconductor rod about its longitudinal axis, for example, in case the comminution action has remained incomplete after the liquid jet has impinged on the circumferential surface of the rod and parts of crystal are still firmly joined to the rod. Usually, these parts of the crystal can only be effectively struck by the liquid jet if the rod is rotated. A further embodiment of the method is to rotate the semiconductor rod continuously about its longitudinal axis and to advance the rod in the axial direction while one liquid jet or a plurality of liquid jets are directed against the rod simultaneously or consecutively from different directions.

It may occasionally happen that, although the semiconductor material has been comminuted by the liquid jet, the fragments are hooked into one another or jammed so that it appears as if there is still a firm joint between them. Since the forces to be applied to overcome the cohesion of the fragments in this case are small, the individual fragments can be separated from one another with a mechanical tool having a working surface composed of a noncontaminating substance, for example plastic, ceramic or the semiconductor material itself. Of course, a liquid jet can again also be used for this purpose.

It is possible, with the method hereinbefore described, to comminute semiconductor material in a contamination-free manner into fragments whose mean size can be predetermined by the suitable choice of method parameters. Furthermore, the proposed method is notable for the fact that, during the comminution, only a small proportion of fine fragments or dust is produced. The comminution method does not need the addition of material having abrasive action. The cleaning of the comminuted material is no longer absolutely necessary and if it is nevertheless to be carried out, substantially less cleaning agent is needed for it.

BRIEF DESCRIPTION OF THE DRAWINGS

Other objects and features of the present invention will become apparent from the following detailed description considered in connection with the accompanying drawing which discloses an embodiment of the present invention. It should be understood, however, that the drawing is designed for the purpose of illustration only and not as a definition of the limits of the invention.

An apparatus with which the method according to invention can be carried out is described below with the reference to the figure. The device shown is to be understood as an exemplary embodiment. Only the device features needed for a better understanding of the invention are shown.

DETAILED DESCRIPTION OF PREFERRED EMBODIMENT

Turning now in detail to the drawing, the apparatus of the invention comprises a container 1 for receiving the comminuted semiconductor material 4 and at least one nozzle 2 through which the liquid jet 3 is directed against the semiconductor material 4 to be comminuted. Although only one nozzle is shown in the figure, a plurality of nozzles may be used. The container 1 is desirably at least partially filled with liquid during the operation so that, if need be, the liquid jet does not impinge directly on the base of the container. In the figure, the semiconductor material 4 is shown as a semiconductor rod bent in a U-shape. Of course, semiconductor bodies shaped in any other desired way can, however, also be comminuted with the device shown. The exemplary embodiment shows that the nozzle 2 is of movable design and can be positioned manually or automatically in the three spatial directions by means of the control 5, while the semiconductor material 4 rests in a stationary manner on a supporting surface 6 situated above the container 1.

The supporting surface 6 is composed of a material which does not contaminate the semiconductor material and is preferably a grid-type structure, so that the fragments separated from the rod by means of the liquid jet are able to fall through the grid interstices into the container 1. An NC control (numeric control), for example, can be used to position the nozzle(s). Of course, the apparatus can also be constructed so that means are additionally provided for advancing the semiconductor material. If such means are provided, the nozzle can also be mounted in a positionally fixed manner.

The container 1 is provided with a conveyor device 7 which permits the continuous or intermittent removal of comminuted semiconductor material. Desirably, fine fragments produced during the comminution are readily separated from the other fragments in the container 1, for example, by continuously circulating the liquid contained in the container 1 and discharging the fine fragments with the flow thereby created. In this embodiment, the conveyor device 7 comprises a link conveyor made of plastic or trays which are fixed to plastic links and which may be composed of plastic or the semiconductor material. However, it is also possible, for example, to provide collecting baskets (not shown in the figure) in the container 1, which baskets are manufactured from plastic or the semiconductor material, in order to remove the semiconductor material from the container, if necessary.

The figure furthermore shows an auxiliary basket 8 which serves to collect contaminated rod tips in case the semiconductor material takes the form of rods whose tips were connected to electrodes made of foreign material during the rod production. At the beginning of the comminution method, the semiconductor rod is placed on the supporting surface 6 so that the rod tips are positioned above the auxiliary basket 8. The rod tips are comminuted and separated with the aid of the liquid jet, and the fragments are able to fall into the auxiliary basket 8. Also shown in the figure is a reservoir unit 12 for supplying the nozzle 2 with liquid, a pump 14 for creating the necessary operating pressure in the liquid and control means 16 for releasing and interrupting the liquid jet.

Other objects and features of the present invention will become apparent from the following detailed description considered in connection with the accompanying Example, which discloses an embodiment of the present invention. It should be understood, however, that the Example is designed for the purpose of illustration only and not as a definition of the limits of the invention.

EXAMPLE

A silicon rod having a length of 1 m, a diameter of 120 mm and a weight of 26 kg was comminuted using an apparatus in accordance with the figure. The liquid used was high-purity water to which a pressure of 3600 bar was applied. To create a water jet, the water was forced through a sapphire nozzle having a round nozzle tip. The cross sectional area of the water jet leaving the nozzle tip was approximately 0.05 $mm^2$. Individual water-Jet pulses of one-second duration were delivered against the circumferential surface of the silicon rod. The nozzle was positioned in such a way that the water jet was directed radially against the circumferential surface of the rod. The spacing of the nozzle tip from the rod surface was 10 mm. After every water-jet pulse which had been directed against the silicon rod, the nozzle was displaced by 50 mm parallel to the longitudinal axis of the rod. The silicon fragments obtained had a predominantly maximum length of 40–120 mm.

While only one embodiment of the present invention has been shown and described, it is to be understood that many changes and modifications may be made thereunto without departing from the spirit and scope of the invention as defined in the appended claims.

What is claimed is:

1. A method for the combinationn-free comminution of semiconductor material, said material having a surface, which method comprises creating at least one pure liquid jet by applying pressure to a pure liquid and forcing it through a nozzle;

placing the semiconductor material on a supporting surface;

directing the pure liquid jet against the semiconductor material, said semiconductor material being selected from the group consisting of fragments, blocks, and rod-shaped material, so that it impinges on said surface of the semiconductor material at high velocity; and wherein the semiconductor material is selected from the group consisting of silicon, germanium and gallium arsenide.

2. The method as claimed in claim 1, comprising applying a pressure of 500 to 5000 bar to the pure liquid.

3. The method as claimed in claim 2, comprising applying a pressure of 1000 to 4000 bar to the pure liquid.

4. The method as claimed in claim 1, comprising directing the pure liquid jet against the semiconductor material in such a way that it impinges on said surface at an angle of 30° to 90°.

5. The method as claimed in claim 1, wherein the jet has a cross-sectional area of 0.005 to 20 $mm^2$ on leaving the nozzle.

6. The method as claimed in claim 1, comprising periodically interrupting the pure liquid jet; and maintaining the pure liquid jet for a time duration of 0.5 to 5 seconds.

7. The method as claimed in claim 1, comprising directing the pure liquid jet against the semiconductor material from a position which is far enough away from the semiconductor material for the length of the pure liquid jet not to exceed 150 mm.

8. The method as claimed in claim 1, wherein the pure liquid jet is selected from the group consisting of water, an aqueous cleaning solution, an aqueous etching solution, an organic solvent, and an organic solvent mixture.

9. The method as claimed in claim 1, comprising directing two to five pure liquid jets against the semiconductor material from different directions.

* * * * *